United States Patent [19]

White et al.

[11] 4,324,392

[45] Apr. 13, 1982

[54] MOLTEN METAL POURING DEVICE

[75] Inventors: Ellis S. White, Elkhart; William C. Zatkoff, South Bend, both of Ind.; John J. Light, Niles, Mich.; Ramon Michen, Mishawaka, Ind.

[73] Assignee: Sandmold Systems, Inc., Newaygo, Mich.

[21] Appl. No.: 118,476

[22] Filed: Feb. 4, 1980

[51] Int. Cl.[3] ..... B22D 37/00

[52] U.S. Cl. ..... 266/240; 164/337; 222/604

[58] Field of Search ..... 266/240; 164/337; 222/604, 606, 607

[56] References Cited

U.S. PATENT DOCUMENTS

| | | | |
|---|---|---|---|
| 3,658,119 | 4/1972 | Hunt et al. | 164/337 X |
| 4,044,927 | 8/1977 | Seaton | 222/604 |
| 4,112,998 | 9/1978 | Sato | 222/604 X |

*Primary Examiner*—M. J. Andrews

*Attorney, Agent, or Firm*—Richard C. Conover

[57] ABSTRACT

An improved apparatus for pouring molten metal into a mold or other cavity. The apparatus includes a tiltable pouring ladle having a pouring spout disposed coaxially with the axis of rotation or tilt of the ladle to permit pouring of metal in a direction coincident with such axis of rotation. The apparatus is further provided with a positionable pouring trough for directing molten metal from the pouring spout to a pouring cup located at any position on the mold surface. With this apparatus, a fixed relationship between the pouring spout, the pouring trough, and the mold surface at any phase of the pouring process may be maintained such that the trajectory of molten metal being poured through air is minimized. The ladle is shaped such that molten metal may be poured at a rate proportional to the tilting rate of the ladle. The ladle also includes apparatus for preventing impurities such as slag or dross inclusions introduced into the ladle with the molten metal from being poured into the casting. The entire apparatus is contained within a frame permitting it to be readily attached to a coventional crane or monorail system as an easily effected substitute for a conventional manual pouring device.

11 Claims, 8 Drawing Figures

MOLTEN METAL POURING DEVICE

BACKGROUND OF THE INVENTION

This invention relates to apparatus for manually pouring molten metal into a mold during a metal casting process and, in particular, to an improved tiltable ladle which permits pouring of molten metal under operator control whereby metal spillage, heat loss from the molten metal during transfer to the mold and required operator concentration may be minimized.

In the manual metal casting industry, castings are poured from manually controlled pouring ladles which have been filled with molten metal at a molten metal source and transported by crane or by a monorail system to the molding area where the metal is poured from the ladles into the individual molds. These conventional pouring ladles are cylindrical in shape about either a vertical or horizontal axis, but in some instances are segmental in shape about a horizontal axis, and are fitted with a pouring lip or spout. In normal foundry practice today, these ladles are rotated about a horizontal axis to permit metal to overflow the pouring lip and spill from the ladle in a direction perpendicular to the axis of rotation or tilt of the ladle and directly into a pouring cup on the mold surface. Furthermore, although not in general practice today, it is known that molten metal also may be poured into runner boxes for directing the molten metal to a pouring cup on the mold surface instead of pouring directly into the pouring cup. Such previously known pouring ladles are shown, for example, in U.S. Pat. No. 284,005 to Hainsworth; U.S. Pat. No. 4,025,060 to Fujie; and U.S. Pat. No. 4,112,998 to Sato.

The requirements for pouring a satisfactory mold can be quite rigid, depending upon the design of the casting to be poured. In general, these requirements are as follows:

1. The metal must have sufficient temperature to flow properly within the mold cavity.
2. Metal flow must be commenced and maintained at a sufficiently rapid rate of flow to maintain a level of metal within the pouring cup throughout the pour, preventing inpurities floating on the metal surface being carried into the mold cavity.
3. Metal flow must be maintained continuously throughout the pour.
4. Metal pressure within the mold must be held to a level that will prevent damage to the mold interior.

In addition to the above, the economics of production require that pouring be terminated before metal has overfilled the pouring cup and run out over the mold surface and solidified.

With a conventional pouring device, where pouring is directed perpendicular to the axis of rotation of the ladle such as shown in U.S. Pat. No. 4,112,998 to Sato, the physical configurations of the mold and the pouring device usually prevent the pouring lip of the device from being brought into close proximity with the pouring cup. Thus, the molten metal trajectory to the pouring cup must be directed accurately to fulfill the requirements of a satisfactory pour. If the pouring cup position changes from mold to mold, the molten metal trajectory must be changed requiring high operator skill and concentration to avoid excessive spilling and damage to the casting. Furthermore, with front lip pouring ladles, substantial heat loss of the molten metal occurs when the molten metal stream passes through the air in a trajectory between the pouring ladle and the pouring cup. This heat loss increases with the length of this trajectory.

It should therefore be apparent that proper pouring from front lip pouring ladles directly into a pouring cup or into a transfer trough requires a high degree of operator coordination and extreme concentration. When it is also considered that the operator is working in a very hot and dirty environment and that any slight miscalculation of metal trajectory or flow will result in the probable splashing and loss of molten metal or the destruction of a casting, it is obvious that a great need exists for a device to optimize operator performance and minimize required operator skills.

There are other conventional pouring devices generally used in a continuous iron pouring line which have ladles which pour in direction coincident with the axis of rotation of the ladle during pouring. Such ladles are shown in U.S. Pat. Nos. 3,940,021; 3,997,461 and 4,044,927. In all of these devices, the ladles are provided with nozzles to pour directly into the pouring cup in a mold. The iron pouring lines are automatic and the molten metal is always poured to the same location. This apparatus cannot be used when the pour cup changes from mold to mold such as in a manual or custom foundry.

SUMMARY OF THE INVENTION

The present invention overcomes the disadvantages of prior manual pouring devices by providing a versatile pouring ladle for pouring molten metal from the ladle to any point on a mold surface.

A manually operated ladle is provided having a pouring spout coincident with the axis of rotation of the ladle to permit pouring along the axis of rotation. The ladle is elongate and has a generally "U" shaped cross section perpendicular to the longitudinal axis. With this configuration, the ladle can carry more molten metal than a conventional sector shaped ladle of the same height, width and length.

The molten metal is poured through the spout into a trough which directs the molten metal to any desired location on the mold surface.

The ladle further includes a baffle between a metal receiving compartment and a metal pouring compartment which has a metal transfer slot located such that during most of the pouring range of the ladle, the metal transfer slot lies below the molten metal surface. This baffle acts to confine most of the slag and dross inclusions within the receiving compartment during pouring. Refractory design of the interior of the ladle provides a constant metal surface area within the ladle bowl at all ladle tilt angles within the pouring range of the ladle to provide a constant pouring rate as the ladle is tilted at a constant rate.

With the present invention, the manual pouring is accomplished with less operator concentration than with prior manual pouring devices. Furthermore, heat losses caused by the molten metal traveling through air are minimized by minimizing the distance between the pouring spout and the trough as well as the distance between the trough discharge end and the pouring cup on the mold.

Furthermore, the ability to maintain a fixed trough location relative to the pouring cup, coupled with control of the rate of metal flow permits the maintenance of nearly constant metalstatic pressure within the mold during the casting process.

BRIEF DESCRIPTION OF THE DRAWINGS

For a better understanding of the invention, reference may be made to the following detailed description of a representative embodiment, taken in conjunction with the figures of the accompanying drawings in which.

DESCRIPTION OF A PREFERRED EMBODIMENT

Figure 1:
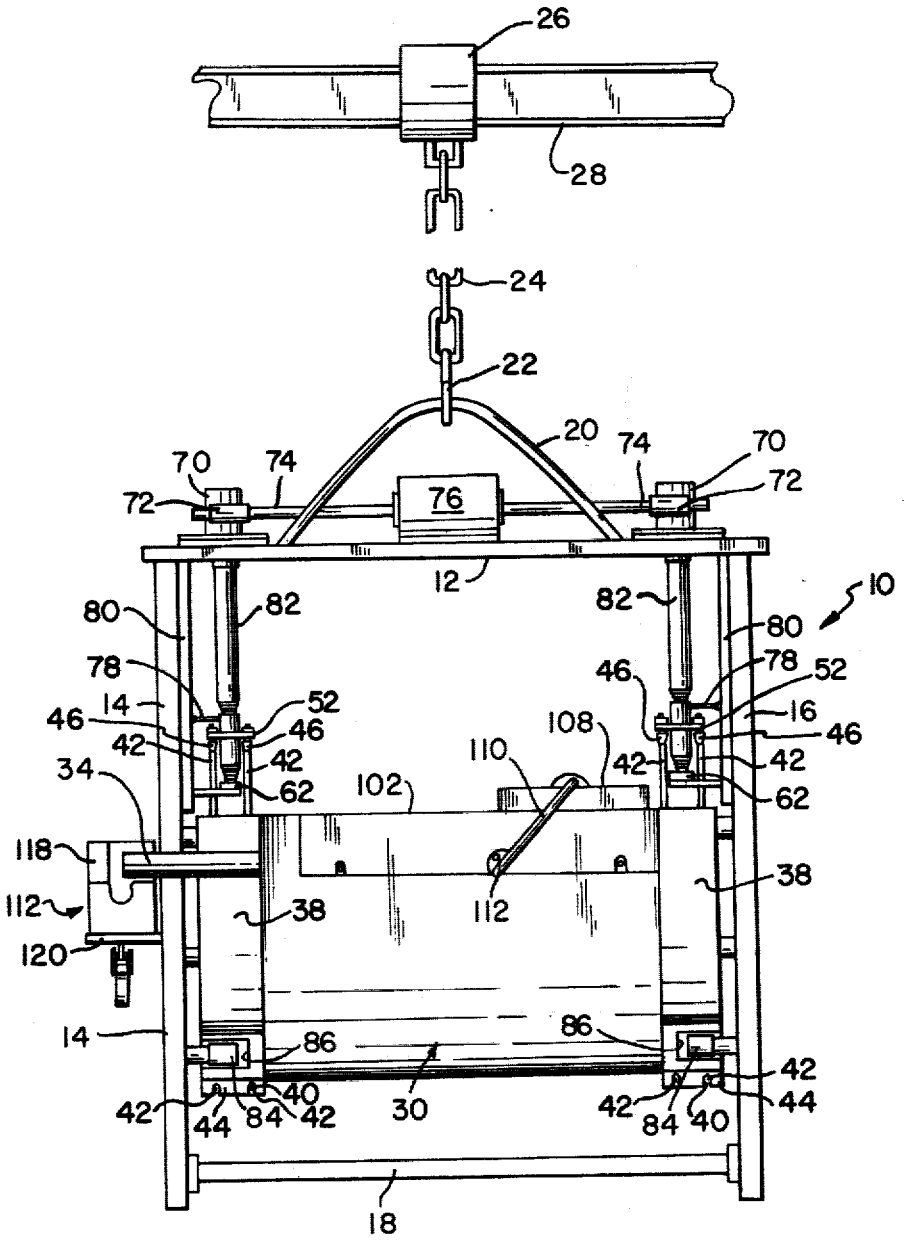
FIG. 1 is a front elevational view of the molten metal pouring device according to the present invention with the ladle in a non-pouring position.
Figure 2:
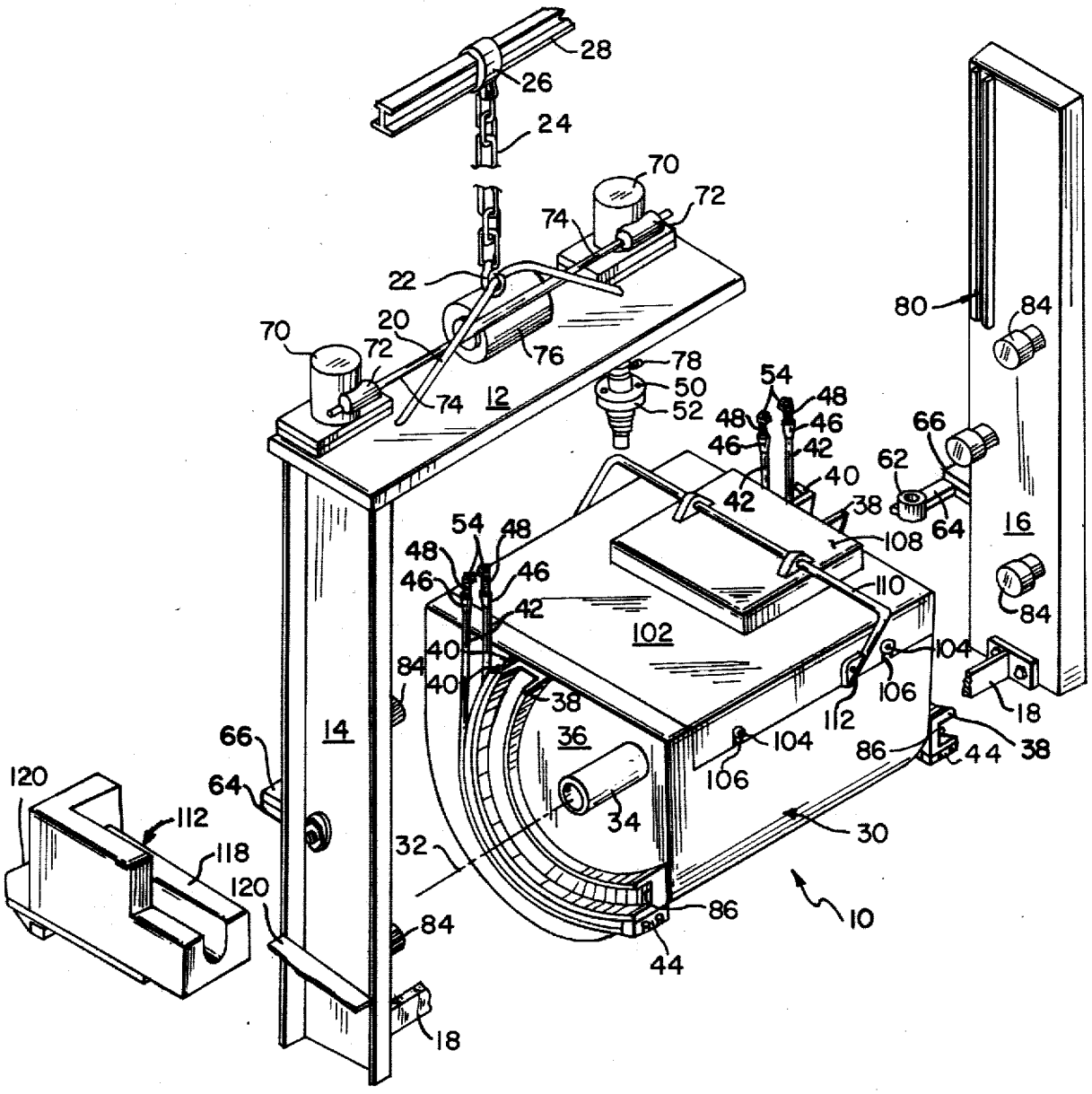
FIG. 2 is a perspective exploded view of the molten metal pouring apparatus shown in FIG. 1.
Figure 3:
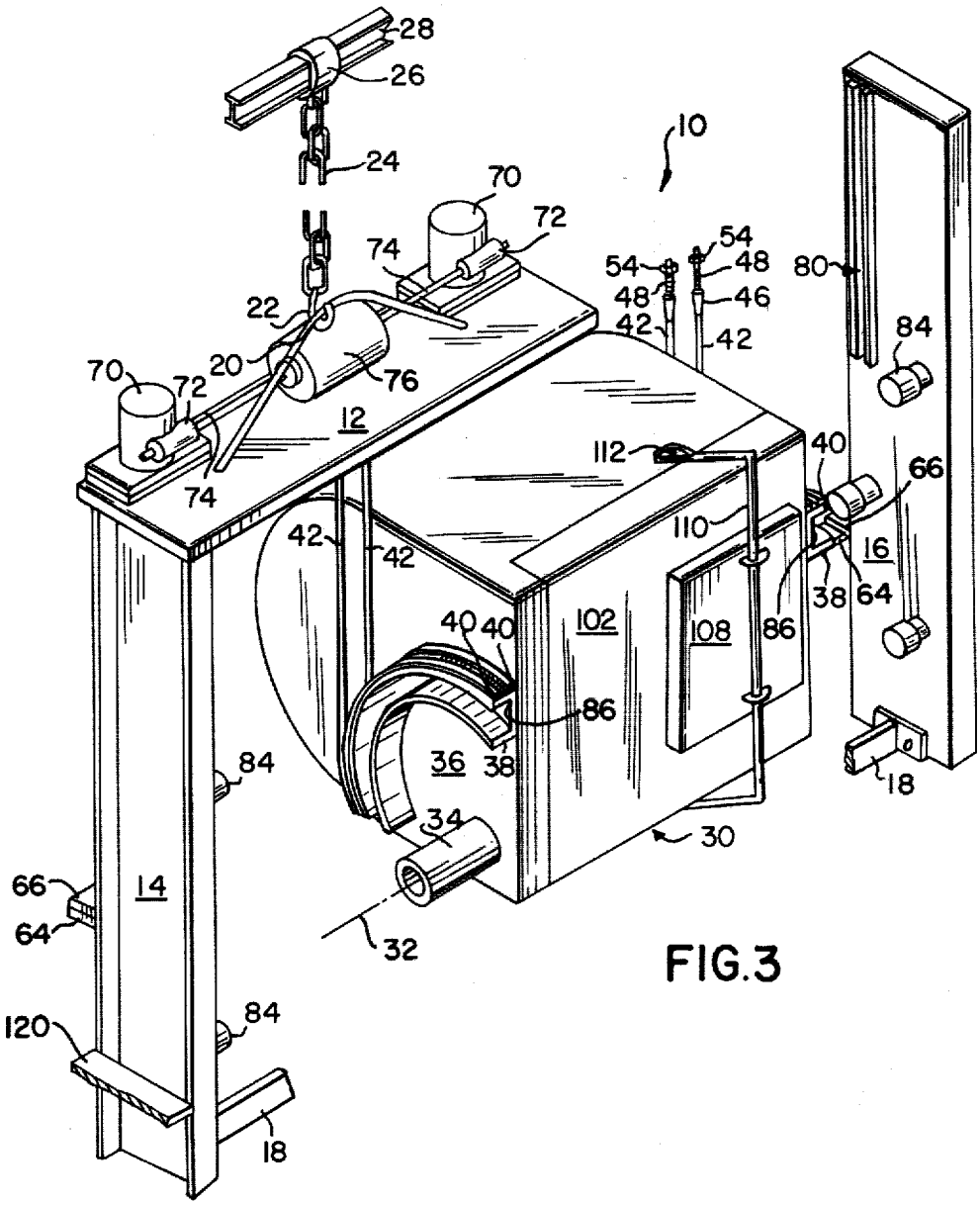
FIG. 3 is a perspective exploded view of the molten metal pouring device according to the present invention with the ladle in the fully tilted position.

A molten metal pouring apparatus 10 according to the present invention is shown in FIGS. 1, 2 and 3. The apparatus includes a ladle 30 which may be tilted about a longitudinal axis of rotation 32 to pour molten metal contained within the ladle. The ladle 30 is generally elongate along the axis of rotation and has a generally "U" shaped cross section perpendicular to the axis of rotation. This apparatus includes a frame for supporting the ladle 30 comprising a top bail member 12, joining two side support members 14 and 16 and also a lower stabilizing bar 18 joining the two side support members 14 and 16. The bail member 12 has a bar handle 20 which is held by a conventional hook 22, chain 24 and hoist 26 riding on an overhead track 28.

The ladle 30 is provided with a tubular pouring spout 34 which is disposed on an end wall 36 of ladle 30 with the longitudinal axis of pouring spout 34 coincident with the longitudinal axis of rotation 32. Ship channel members 38 are mounted on each end wall of ladle 30 with the closed end of the channels affixed to the end walls of ladle 30 as by welding. All ship channel members 38 are bent in a curvilinear shape and are affixed to end walls of ladle 30 radially spaced from and concentric to the pouring spout 34. Cable guide members 40 are affixed to an outer leg of the curved ship channel members 38 for carrying lifting cables 42. In a preferred embodiment, there are two lifting cables 42 on each end of the ladle 30. One terminal end of each of the lifting cables 42 is affixed in a conventional manner to corresponding anchor portions 44 which form a portion of the cable guide members 40.

Figure 4:
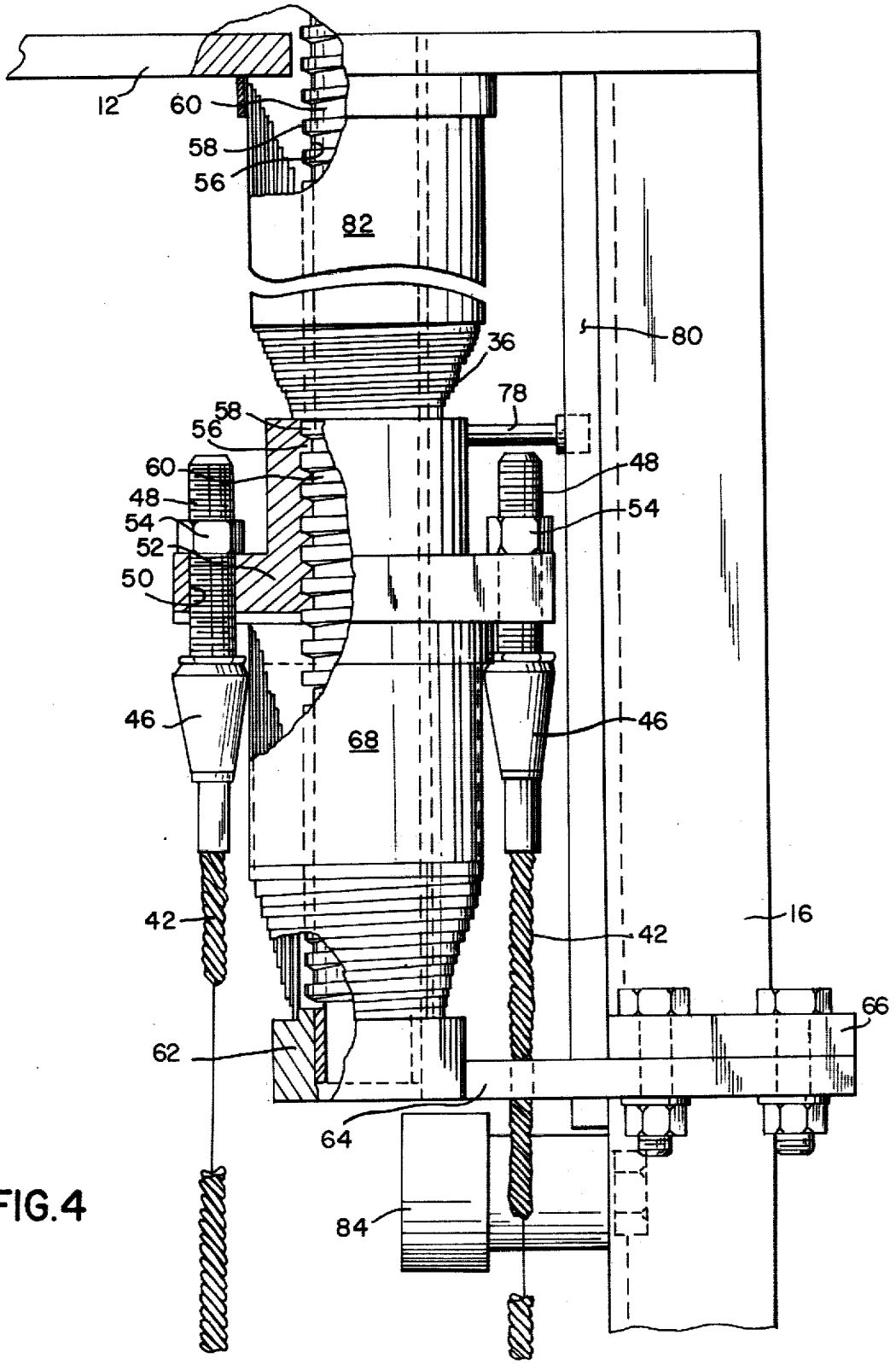
FIG. 4 is a front elevational view partially in section showing the connection between the lifting cables of the ladle and the lifting member for tilting the ladle.

The other terminal ends of lifting cables 42 are received by and affixed to connectors 46, as shown in FIGS. 1 and 4, which have threaded upper portions 48. The threaded portions 48 are received through bores 50 in lifting members 52 and nuts 54 are then threaded on the threaded portions 48 extending through bores 50 whereby lifting cables 42 are held and retained by lifting members 52. FIG. 4 is a detailed view showing the connection of one pair of lifting cables 42 to a lifting member 52. The other pairs of lifting cables 42 at the other end of ladle 30 are connected similarly to another lifting member 52. Each lifting member 52 has interior threads 56 for engaging threads 58 of a machine screw support rod 60. The lower end of machine screw support rod 60 is supported by a conventional machine screw bearing 62 affixed to a supporting member 64. The supporting member 64 is bolted at one end to a projecting member 66 which is affixed as by welding to the respective side support members 14 and 16 as shown in FIGS. 2 and 4. A telescoping cover 68 surrounds the threads 58 of machine screw support rod 60 between the lifting member 52 and the bearing 62 as shown in FIG. 4 to protect the threads during use of the metal pouring apparatus.

The upper end of each of the machine screw support rods 60 engages conventional intermediate gearing assemblies 70 as shown in FIG. 1, which in turn engages conventional drive gearing assemblies 72 mounted at one end of drive shaft 74. The drive shafts 74 are connected to a conventional reversible variable speed drive motor 76. Drive gearing assemblies 72, intermediate gearing assemblies 70 and machine screw support rods 60 are all conventional assemblies such as Jactuator manufactured by Duff-Norton Company. The housings of intermediate gearing assemblies 70 and drive motor 76 are mounted on bail plate 12 as shown in FIGS. 1 and 2.

A lifting member cam follower 78 is mounted on each of the lifting members 52. These cam followers 78 ride in lifting member cam guides 80 mounted on side support frames 14 and 16 as shown in FIGS. 1 and 2 to prevent rotation of the lifting members 52 when machine screw support rods 60 are rotated by drive motor 76 to move lifting members 52 upwardly or downwardly.

An upper telescoping cover 82 is connected between the top of each lifting member 52 and bail plate 12 as shown in FIG. 4 to protect the upper threads of machine screw support rod 60 during operation.

During tilting, ladle 30 is guided with respect to the structural framework provided by side frame supports 14 and 16, bail plate 12 and lower stabilizing bar 18 by cam followers 84 mounted on side frame supports 14 and 16 as shown in FIG. 2. These cam followers 84 ride in the "U" shaped channel 86 provided by ship channel members 38 mounted on the ladle 30.

To rotate the ladle 30 for pouring molten metal contained therein an operator actuates drive motor 76 whereby machine screw support rods 60 are rotated in lifting members 52. The drive motor 76 is actuated by an operator using conventional control apparatus (not shown). Depending on the direction of rotation of machine screw support rods 60, the lifting members 52 move upwardly or downwardly. If lifting members 52 are moved upwardly, they draw lifting cables 42 with them thereby rotating the ladle 30 about the axis of rotation 32 of the ladle which extends through the spout 34. The ladle 30 is guided during the rotation by cam followers 84 riding in the "U" shaped channel 86.

Figure 5:
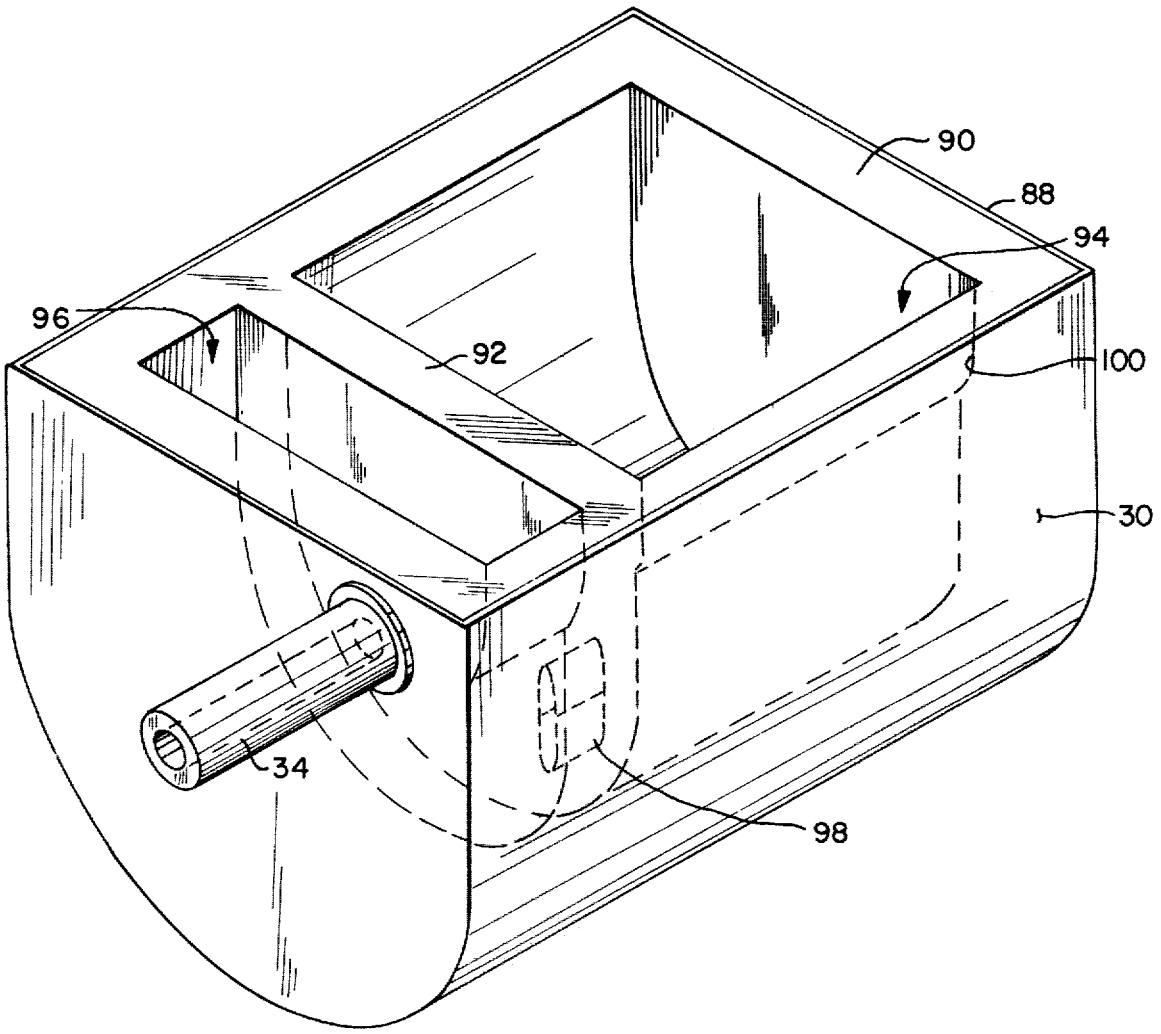
FIG. 5 is a perspective view of a ladle utilized in the present invention showing the interior thereof.

In a preferred embodiment, ladle 30 has a steel outer wall 88 and a refractory lining 90 as shown in FIG. 5 to contain the molten metal. The interior of ladle 30 is divided by a refractory baffle wall 92 between a metal receiving chamber 94 and metal pouring chamber 96. Molten metal can flow between the chamber through a metal transfer slot 98. Metal transfer slot 98 is positioned near the bottom and front wall of ladle 30 so that it will remain beneath the molten metal surface during all but the final stages of emptying ladle 30 thereby preventing impurities which normally float on the molten metal surface from entering the metal pouring chamber 96 and ultimately the casting itself.

In a preferred embodiment, the refractory liner 90 contains an offset, generally designated as 100, designed to maintain a constant metal surface area at all angles of tilt of ladle 30 throughout the pouring range.

As the ladle 30 is rotated about the axis of rotation 32 by activation of drive motor 76, molten metal will be poured out spout 34 from the metal pouring chamber 96. Further, this molten metal is replenished by molten metal contained within the receiving chamber 94 through metal transfer slot 98.

As seen in FIG. 2, a refractory lined metal cover 102 may be placed over the open upper portion of ladle 30. This cover 102 is held in place on ladle 30 by nut and bolt arrangement 104 cooperating with slots 106 in cover 102. With this arrangement cover 102 may be removed for refractory liner replacement or repair. An opening is left in metal cover 102 over the metal receiving chamber 94 through which the ladle 30 can be refilled after emptying. This opening is covered by a movable door 108 rotatably mounted to a rodlike movable cover handle 110. Each end of cover handle 110 is rotatably mounted on pins 112 affixed to the cover 102 so that the movable door 108 may be swung away from the opening metal cover 102 when the ladle 30 is to be replenished with molten metal.

Figure 6:
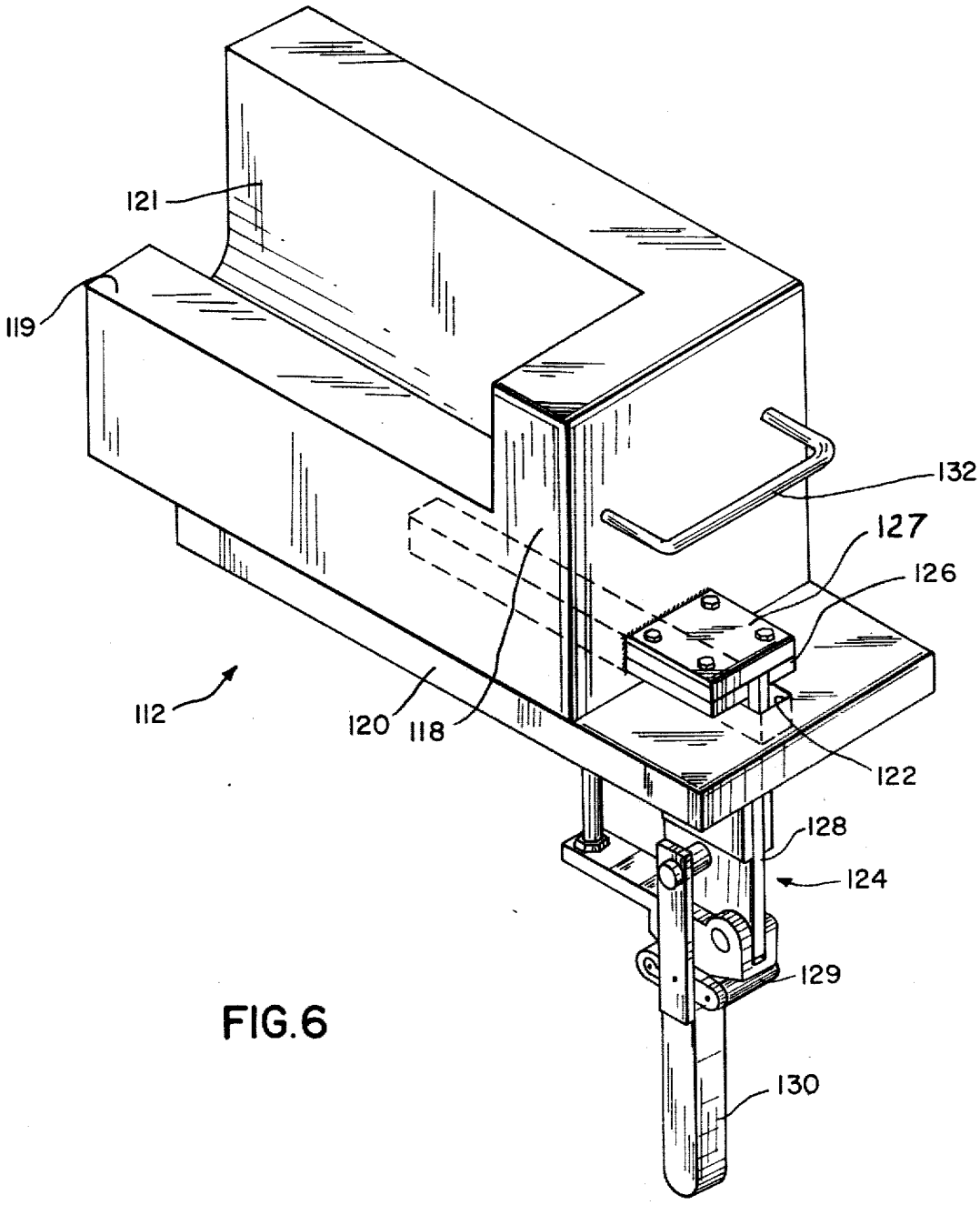
FIG. 6 is a perspective view of a molten metal transfer trough utilized in the present invention.
Figure 7:
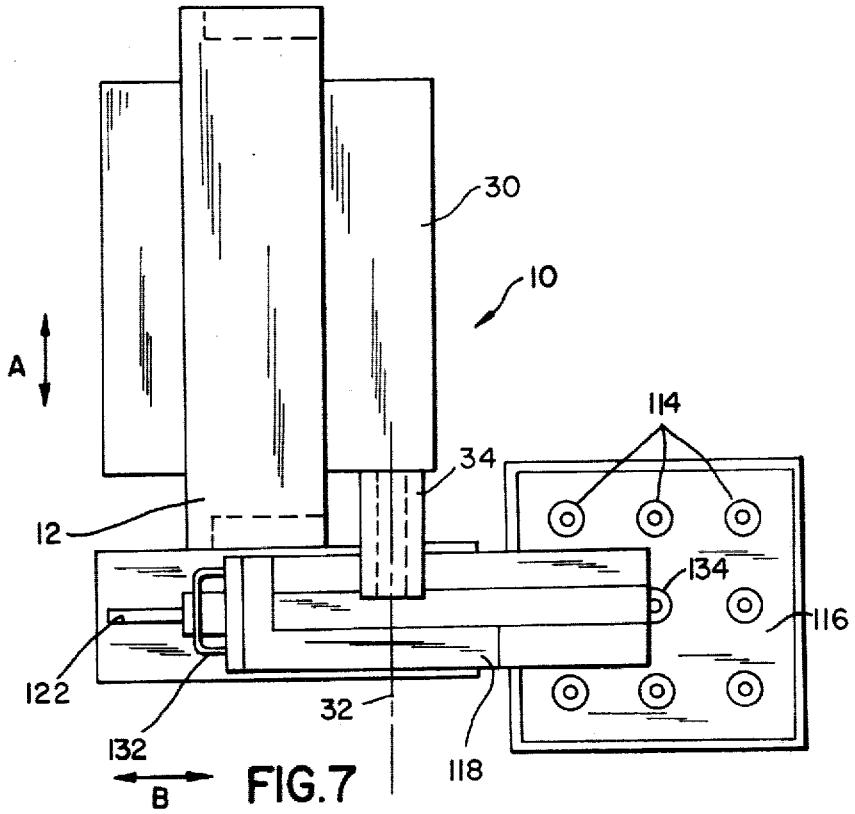
FIG. 7 is a schematic plan view of the molten metal pouring device according to the present invention illustrating its capability of pouring into any selected pouring cup located on a casting mold.

Molten metal from ladle 30 is poured into a metal transfer trough 112 for delivery to any selected pouring cup 114 in a mold 116 as shown in FIGS. 1 and 7. The metal transfer trough 112 is shown in FIG. 6 and includes a trough 118 slidably mounted on a trough support plate 120 which in turn is affixed as by welding to side support frame 14 as shown in FIG. 1. The trough support plate 120 includes a slot 122 through which extends a conventional trough clamp 124, for example, a Knu-Vise Model #CAV 1200 obtained from Lapeer Mfg. Co. The trough 118 includes a projecting clamp mounting plate 127 affixed as by welding thereto. The trough clamp 124 includes a bolting plate 126, which is bolted to mounting plate 127, and a guide member 128, mounted transversely to bolting plate 126, which rides in slot 122. The trough clamp 124 further includes a lower clamp member (not shown) which clears the lower surface of plate 120 during movement of the trough 118 on plate 120 and an over-center mechanism 129 actuated by handle 130. In one position of handle 130, trough clamp 124 clamps trough 118 to support plate 120 by frictionally clamping lower clamp member (not shown) against plate 120. In the other position, the trough 118 is released and may be moved in the direction of slot 122. Trough handle 132 is provided to facilitate the positioning of trough 118.

The trough 118 is further provided with an upwardly extending side member 119 and a parallel upwardly extending side member 121, as shown in FIG. 6. The height of side member 119 is less than the height of side member 121 so that during pouring, when spout 34 rests near the top surface of side member 119 and pouring commenced, the side member 121 will reduce or prevent spillage of molten metal as the molten metal splashes against side wall 121.

The slot 122 runs perpendicular to the axis of rotation 32 of ladle 30 as shown in FIG. 7; thus the discharge end of metal transfer trough 118 may be laterally positioned with respect to the axis of rotation of ladle 30 to a selected pouring cup 114 on the mold 116.

To align the end porition of metal transfer trough 118 with a particular pouring cup 114 on mold 116, the operator manually moves the entire metal pouring apparatus 10 with hoist 26 riding on overhead track 28 in the direction "A" as shown in FIG. 7 until the metal transfer trough 118 is longitudinally aligned with the pouring cup of interest, for example, 134 as shown in FIG. 7. The operator then releases trough clamp 124 and adjusts the lateral position of the metal transfer trough 118 by handle 132 in the direction "B" until the discharge end of metal transfer trough 118 is properly aligned with pouring cup 134 on mold 116 at which time he then locks the metal transfer trough 118 in position with trough clamp 124. By positioning apparatus 10 with respect to the mold 116 as shown in FIG. 7, it is possible to pour to any pouring cup on the mold surface 116.

Figure 8:
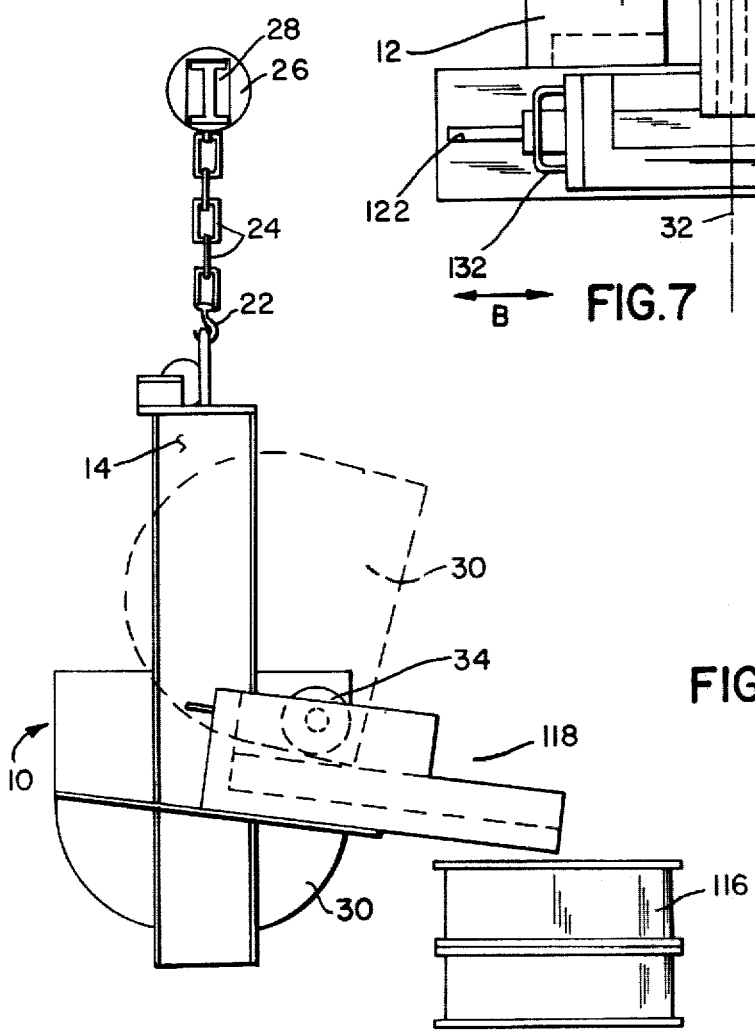
FIG. 8 is a schematic side elevation view of the molten metal pouring device shown in FIG. 7.

To pour molten metal into the pouring cup 134, the ladle 30 is tilted by an operator actuating drive motor 76 from a non-pour position shown in solid lines in FIG. 8 to the full tilt position shown in dotted lines in FIG. 8 and molten metal is poured through spout 34 as shown in FIG. 8 into trough 118 and thence to pouring cup 134. All this being done at a rate determined by and under control of the operator.

Thus, with this apparatus, the operator has improved control for directing molten metal to a selected pouring cup thereby minimizing metal spillage and required operator concentration. Furthermore, the operator has optimum control over the pouring rate, and with the position of the pouring spout 34 and metal transfer trough 118 securely maintained during pouring, the operator can maintain nearly constant ferrostatic pressure within the mold through the entire pouring operation. In addition, since the pouring spout 34 is closely adjacent to the metal transfer trough 118, and the discharge end of the metal transfer trough 118 is closely adjacent to the pouring cup on the mold, the molten metal trajectory through air is minimized, thereby minimizing heat loss from the molten metal during delivery to the mold.

While the fundamental novel features have been shown and described, and while the basic invention is intended for application as a manual pouring device, it should be understood that various substitutions, modifications and variations may be made by those skilled in the art without departing from the spirit or scope of the invention. Accordingly, all such modifications and variations are included in the scope of the invention as defined by the following claims:

We claim:

1. Apparatus for manually pouring molten metal into a pouring cup in a mold comprising:

an elongate ladle for holding molten metal, the ladle having a pair of opposed end walls and having a pair of opposed side walls and a bottom wall, the cross section of the side walls and bottom wall along a section perpendicular to a longitudinal axis of the ladle having a "U" shaped outer periphery which for each section between the opposed end walls is of similar size and shape;

means for tilting the ladle about an axis of rotation to pour molten metal therefrom; and the ladle having a molten metal discharge spout coincident with the axis of rotation of the ladle whereby upon tilting the ladle molten metal is discharged through the spout in a direction coincident with the axis of rotation of the ladle.

2. The apparatus according to claim 1 further including:

a frame for supporting the ladle; and a positionable metal transfer trough mounted to the frame for receiving molten metal from the discharge spout and directing such molten metal to a selected pouring cup in the mold.

3. The apparatus according to claim 2 wherein the positionable metal transfer trough is positionable in a horizontal plane and in a direction perpendicular to the axis of rotation of the ladle.

4. The apparatus according to claim 1 wherein the ladle is refactory lined and further includes an interior baffle wall dividing the ladle interior into a metal receiving chamber and a metal pouring chamber and wherein the discharge spout is disposed in fluid communication with the metal pouring chamber and wherein the baffle wall includes an opening providing fluid communication between the metal receiving chamber and the metal pouring chamber and positioned such that the opening is below the surface of molten metal contained in the ladle during pouring until the ladle is tilted substantially to its maximum tilt whereby the ladle is substantially emptied of molten metal.

5. The apparatus according to claim 1 further including control means for controlling the rate of tilt of the ladle about its axis of rotation during pouring.

6. The apparatus according to claim 1 wherein the interior of the ladle is shaped to provide a substantially constant molten metal surface area during pouring.

7. Apparatus for manually pouring molten metal into a pouring cup in a mold comprising:

a ladle for holding molten metal;

means for tilting the ladle about an axis of rotation to pour molten metal therefrom;

the ladle having a molten metal discharge spout coincident with the axis of rotation of the ladle whereby upon tilting the ladle molten metal is discharged through the spout in a direction coincident with the axis of rotation of the ladle; and a positionable metal transfer trough mounted to the frame for receiving molten metal from the discharge spout and being positionable to direct such molten metal to a selected pouring cup on the mold.

8. The apparatus according to claim 7 wherein the positionable metal transfer trough is positionable in a horizontal plane and in a direction perpendicular to the axis of rotation of the ladle.

9. The apparatus according to claim 7 wherein the ladle is refractory lined and further includes an interior baffle wall dividing the ladle interior into a metal receiving chamber and a metal pouring chamber and wherein the discharge spout is disposed in fluid communication with the metal pouring chamber and wherein the baffle wall includes an opening providing fluid communication between the metal receiving chamber and the metal pouring chamber and positioned such that the opening is below the surface of molten metal contained in the ladle during pouring until the ladle is tilted substantially to its maximum tilt whereby the ladle is substantially emptied of molten metal.

10. The apparatus according to claim 7 further including control means for controlling the rate of tilt of the ladle about its axis of rotation during pouring.

11. The apparatus according to claim 7 wherein the interior of the ladle is shaped to provide a substantially constant molten metal surface area during pouring.

* * * * *